US010281158B2

(12) United States Patent
Herrera

(10) Patent No.: US 10,281,158 B2
(45) Date of Patent: May 7, 2019

(54) RANGE PROTECTIVE COVER

(71) Applicant: Ronnie Herrera, San Antonio, TX (US)

(72) Inventor: Ronnie Herrera, San Antonio, TX (US)

( * ) Notice: Subject to any disclaimer, the term of this patent is extended or adjusted under 35 U.S.C. 154(b) by 383 days.

(21) Appl. No.: 15/078,650

(22) Filed: Mar. 23, 2016

(65) Prior Publication Data

US 2017/0276377 A1 Sep. 28, 2017

(51) Int. Cl.
*F24C 15/10* (2006.01)
*F24C 15/12* (2006.01)

(52) U.S. Cl.
CPC ..... *F24C 15/12* (2013.01)

(58) Field of Classification Search
CPC ..... F24C 15/007; F24C 15/107; F24C 15/108
USPC ..... 126/211, 219, 229, 221; 99/446
See application file for complete search history.

(56) References Cited

U.S. PATENT DOCUMENTS

| | | | | | |
|---|---|---|---|---|---|
| 727,251 | A | | 5/1903 | Allen | |
| 1,000,185 | A | * | 8/1911 | Melton | F24C 15/12 126/211 |
| 1,370,113 | A | * | 3/1921 | Janusonis | F24C 15/10 126/211 |
| 1,638,770 | A | * | 8/1927 | Jones | F24C 15/10 126/211 |
| 1,710,023 | A | * | 4/1929 | Hoffman | F24C 15/10 126/211 |
| RE20,924 | E | | 11/1938 | Nickle | |
| 2,136,100 | A | * | 11/1938 | Crossman | F24C 15/10 126/211 |
| 3,490,123 | A | | 1/1970 | Clark | |
| 4,045,606 | A | | 8/1977 | Kalkowski | |
| 4,620,526 | A | * | 11/1986 | Tetschner | F24C 15/36 126/211 |
| 5,158,068 | A | | 10/1992 | Pickering | |
| 5,331,945 | A | | 7/1994 | Somerton | |
| 5,353,781 | A | | 10/1994 | Calvillo | |
| 6,044,834 | A | | 4/2000 | Zappetti | |
| 6,209,278 | B1 | * | 4/2001 | Tychsen | E04F 15/04 52/592.1 |
| 6,257,228 | B1 | * | 7/2001 | Braccini | F24C 3/085 126/211 |
| 6,263,869 | B1 | | 7/2001 | Abernethy | |

(Continued)

*Primary Examiner* — Joshua E Rodden
(74) *Attorney, Agent, or Firm* — Eric A. Hinojosa

(57) ABSTRACT

The present invention discloses a novel range cover system for protection of a user's range surface. The range cover system includes the non-obvious combination of independent surface covers and basin covers with optional features such as a backsplash, a surface ridge for liquid retention, range-to-counter-top gap covers, sealing joints for multiple section construction, folding pleats for fit adjustment, range edge protectors, magnetic adherence, adhesive adherence, suction-cup adherence, and visually enhancing graphic designs. The material of construction can be any suitable single material or combination of materials that is heat and flame resistant, and that is preferentially also stain and stick resistant. The benefits of this invention include ease of application, protection to the user's range surface and basin surfaces, increased mess control while using the range, ease of removal and cleaning of the product, increased range durability, and enhanced aesthetic appearance of the user's range and counter-top.

18 Claims, 11 Drawing Sheets

(56) References Cited

U.S. PATENT DOCUMENTS

| | | | | |
|---|---|---|---|---|
| 6,371,105 | B1 * | 4/2002 | Merritt | F24C 15/12 126/211 |
| 6,399,924 | B1 | 6/2002 | Cai | |
| 8,353,282 | B1 | 1/2013 | Fischer | |
| 2009/0064990 | A1 | 3/2009 | Wilkins et al. | |
| 2010/0083948 | A1 | 4/2010 | Faraldi et al. | |
| 2012/0012093 | A1 | 1/2012 | Mishra et al. | |
| 2013/0081608 | A1 | 4/2013 | Bonadio | |
| 2015/0323198 | A1 | 11/2015 | Ratz | |
| 2016/0169532 | A1 * | 6/2016 | Iurk | F24C 15/108 219/452.12 |

* cited by examiner

RANGE PROTECTIVE COVER

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

Cooking on a range, also known as a stove-top, is a commonly performed task for many households and commercial eateries. It is therefore no surprise that cleaning up after the cooking is done is also commonly performed. The chore of cleaning the range can often be an arduous task. Many inventions have tried to make this chore easier by providing a means for protecting the range surfaces from spills, splatters, splashes, crumbs, drips, drops, and everything in between. However, these inventions fail to solve the problem on a number of fronts discussed more below.

U.S. Pat. No. 727,251 (publication U.S. Pat. No. 72,7251 A), entitled Stove-mat, describes a range cover that is designed to be a heat insulator for the purpose of covering the unused sections of a range surface. That prior art claimed to protect the surface of the range and featured lids for the unused cooking surfaces. Many other narrowing limitations were built into the patent owing to the fact that in the year 1903, oven design was significantly different from that seen today (for example, the patent is built to cover "stove-lids" not seen in typical modern cooking surface appliances).

In 1970, patent publication number U.S. Pat. No. 3,490,123 A, entitled Protective aluminum foil cover for stoves, described a basic product comprised of an aluminum sheet with perforations. This aluminum sheet could be torn from a roll and then placed over a range. Then the sections overlapping the range burners could be removed. This provided yet another means of protection suffering from three significant shortcomings. First, foil can't easily be applied to a surface without creating wrinkles which are aesthetically unappealing to many. Second, this invention generates significant amounts of waste in the form of discarded aluminum. Third, the invention is difficult to apply or use without accidentally tearing or puncturing due to the mechanical properties of thin rolled aluminum sheets.

U.S. patent application Ser. No. 05/634,280, publication number U.S. Pat. No. 4,045,606 A, entitled Protective cover for an electric range, describes a range cover that is essentially a large piece of foil with a heat indicator strip and edge grooves to retain liquids. This patent suffers from many of the same draw-backs as the previous prior art.

Patent publication number U.S. Pat. No. 5,158,068 A, entitled Cooktop cover apparatus, describes a range cover to be used only when the burners or heating surfaces are not being used. This is typical of much of the prior art, but is highly contrary to solving the problem of protecting the surface of the range since the cover must be removed while the cooking surface is in use, during which messes are more likely to occur.

Patent publication number U.S. Pat. No. 5,331,945 A, entitled Combination stove top cover and cutting board for recreational vehicles, describes yet another cover for the range to be used only when the burners and cooking surfaces are not being used. This particular invention featured one large cover which suffers from the problem of being bulky. Such a large single cover is unlikely to fit into a sink or dishwasher for convenient cleaning.

Patent publication number U.S. Pat. No. 5,353,781 A, entitled Cook top protector, describes a range cover that has removable panels that expose the cooking surfaces when each will be used. This art also describes the cover as having "flexible fingers" that extend down into the area beneath the burners. The prior art describes the use of long slits in the main cover panel which form the individual fingers. This would be undesirable because liquids could easily run beneath the cover through those slits. Another unique element of this prior art is the description of an optional front facing "skirt" with pockets for easy holding of utensils. This doesn't seem practical for typical oven-range combos which have an oven door located at the front.

Patent publication number U.S. Pat. No. 6,044,834 A, entitled Stove top protective cover, describes a range cover that has multiple concentric perforations for removing circular sections from the main body to allow a cooking surface to pass through. These perforations attempt to give the user the ability to adjust the invention to fit the user's range. However, the unused perforations act as collection sources for liquids to penetrate the protection of the range cover, thereby defeating the principal objective. This prior art contemplates use of flexible fire resistant materials for construction. Another unique element is the inclusion of a "resiliently deformable backing" to the flexible cover. The art describes pushing the cover down into any recesses or depressions in the cooking surface. These measures do allow for some adjustment to the user's range, but the dimensions that are most likely to be different from one particular range model to another are the spacing and relative position of the heating elements. This particular prior art does nothing to address that.

Patent publication number U.S. Pat. No. 6,263,869 B1, entitled Stove cover device, describes a range cover that has an outer frame supporting a removable cover. That is yet another cover not intended or able to be used during cooking. The goal of that prior art is to increase usable counter space rather than to protect the range while it is in use.

Patent publication number U.S. Pat. No. 6,399,924 B1, entitled Cooktop hygiene device and method, describes a range cover that has hinged flaps that are designed to cover the heating elements but which can also allow the transmission of heat so as to be used while the heating element or cooking surface is hot. This prior art discloses the use of a pleated section which allows the cover to stretch or compress to fit different cooking surface spacing configurations. It also describes the use of overlapping flaps to create a seam that can form a seal for different spacing configurations of the cooking surfaces. While this art improved over the previous prior art in the realm of providing for adjustment, it features obstructive hinged flaps. These hinges would be difficult to clean and the flaps are cumbersome to the use of the range. This prior art also discusses an embodiment where the cover is comprised of "basin" or "drip pans" connected to the range cover ("plate like structure") and positioned beneath the heating elements of the range. On the surface it makes sense to have the basins be directly connected to the cover to form a barrier with fewer seams and joints. However, the present inventor believes this is actually an undesirable feature since having basins connected to the range cover would result in a much more difficult application and removal of the product. Furthermore, there is no option to use one apart from the other should the user choose to do so. This aspect also requires the replacement of the whole cover panel in the event that any part of it becomes damaged or unusable.

Patent publication number U.S. Pat. No. 8,353,282 B1, entitled Disposable stove top cover, describes a disposable range cover that has a porous top layer, an absorbent middle layer, and an impermeable bottom layer. This prior art is diametrically opposed to the present invention which seeks to be re-usable to eliminate waste. In the event that one area of the prior art's disposable cover is soiled, the entirety must be replaced; the present invention could easily be wiped or washed and quickly re-applied to the range.

U.S. patent application Ser. No. 11/900,019, publication number US20090064990 A1, entitled Range roll pliable, heat-resistant silicone stovetop cover for smooth cooktop stoves and ranges, describes the basic invention of a range cover. This application does not disclose the use of holes for the burners or heating elements to pass through. In fact, the application touts the fact that it covers burners as a valuable feature to prevent burns from accidental contact. It does disclose the use of silicone and optional graphics on the cover. It is an important goal of the present invention to allow the cover to be used while the user is cooking on the range without worry of burning or melting the cover.

U.S. patent application Ser. No. 12/571,489, publication number US20100083948 A1, entitled Protective liner and system for protecting a cooking top, describes a disposable range cover that is applied in a stack and can have the outermost layer peeled off to reveal another clean cover sheet. The bottom surface of the cover features an adhesive coating to allow it to be secured to the range surface. It is also disclosed that a magnetic portion could be used to achieve the securing of the cover to the range. Another aspect disclosed in this prior art is the use of centering pins and corresponding holes to align the cover to the range. It is the goal of the present invention to eliminate the need for centering pins or multiple disposable sheets by providing a range cover that is cleanable and durable for reuse.

U.S. patent application Ser. No. 12/835,850, publication number US20120012093 A1, entitled Graphic cooktop cover, describes a glass top range cover that features a removable graphic cover with openings for the heating elements. This prior art narrowly focuses on glass top ranges.

U.S. patent application Ser. No. 13/200,792, publication number US20130081608 A1, entitled Stove top shield, describes a range cover that again is only to be used while the heating elements are not in use. This prior art also describes the separation of the cover into discreet sections designed to cover one heating element at a time with seams in between the sections.

U.S. patent application Ser. No. 14/667,846, publication number US20150323198, entitled Stovetop Guard, describes a range cover featuring reversibly detachable heating element cut outs. First the cut outs can be detached from the main range cover section. Then, the cut outs can be reattached by multiple methods including zipper, Velcro (hook and loop), and magnets to name a few. Again these cut outs must be removed prior to turning on the heating section of the range. No basin protection is included in this particular prior art.

BRIEF SUMMARY OF THE INVENTION

In light of the above prior art and the various limitations and short-comings, the present invention is a stove-top cover [[set]]system that provides an optimized level of protection coverage, ease of application, ease of use, ease of removal, ease of cleaning, and longevity.

It is a goal of this invention to provide a novel and here-to-for un-thought of solution to make the chore of cleaning a range much quicker, easier, and safer.

Another goal of the present invention is to eliminate the need to remove or otherwise fiddle with the range cover prior to using the range.

Another goal of the present invention is to provide resistance to the travel of liquids and solids across the outer and inner perimeters, the borders, of the invention.

Yet another goal of the present invention is to cover the range basins more thoroughly by eliminating the gaps and cracks seen in the few prior art designs that even attempt to cover the surface below the heating elements of the range.

It is another goal of the present invention to address the spacing between the heating elements of the range and provide a means of adjusting to and fitting the range better.

Another important goal of the present invention is to be flexible and adjustable while eliminating any task of having to open or remove cover sections prior to using the range.

Another goal of the present invention is to provide a device that is conveniently ready for range use while being simple to install, remove, and clean. To that end, as described in more detail in the Detailed Description of the Invention section, this invention provides for basin covers that are not connected to the range cover. One of ordinary skill in the art would expect the overall range surface protection to be decreased by the introduction of another seam point, however separating the surface cover from the basin covers yields unexpected benefits including improved ease of installation and removal, improved fit across a larger collection of ranges, improved ease of cleaning of each section, and increased product longevity since a single section can be replaced without necessitating that the whole product be replaced.

It is yet another goal of the present invention to provide a re-usable range cover that can be washed or cleaned easily by hand or conventional dishwashing machine and then returned to service promptly.

Additional features, goals, and advantages of this invention will be readily understood from the following descriptions, drawings, and claims.

DETAILED DESCRIPTION OF THE INVENTION

The following description is structured to focus on several preferred embodiments. As is commonly understood, the details of these particular descriptions are intended to be illustrative and should not be construed as limitations on the scope of the invention. One of ordinary skill in the art will appreciate that there are many other possible embodiments based on the disclosures made here which are not expressly discussed in detail.

In a first embodiment, referred to as electric range cover 100, the range cover is suited for an electric range. The electric range cover 100 is comprised of a left surface cover 101 and a right surface cover 131, respectively seen in FIG. 1 and FIG. 5. As further seen in FIG. 9, electric range cover 100 is additionally comprised of at least one basin cover 161, though preferentially as many as the user's range has basins (typically four). The left surface cover 101 and the right surface cover 131 are connected and positioned on the surface of a user's electric range. The at least one basin cover 161 is positioned above the electric range basin and below the heating element of the user's electric range. This first embodiment includes many features which are optionally included.

Figure 1:
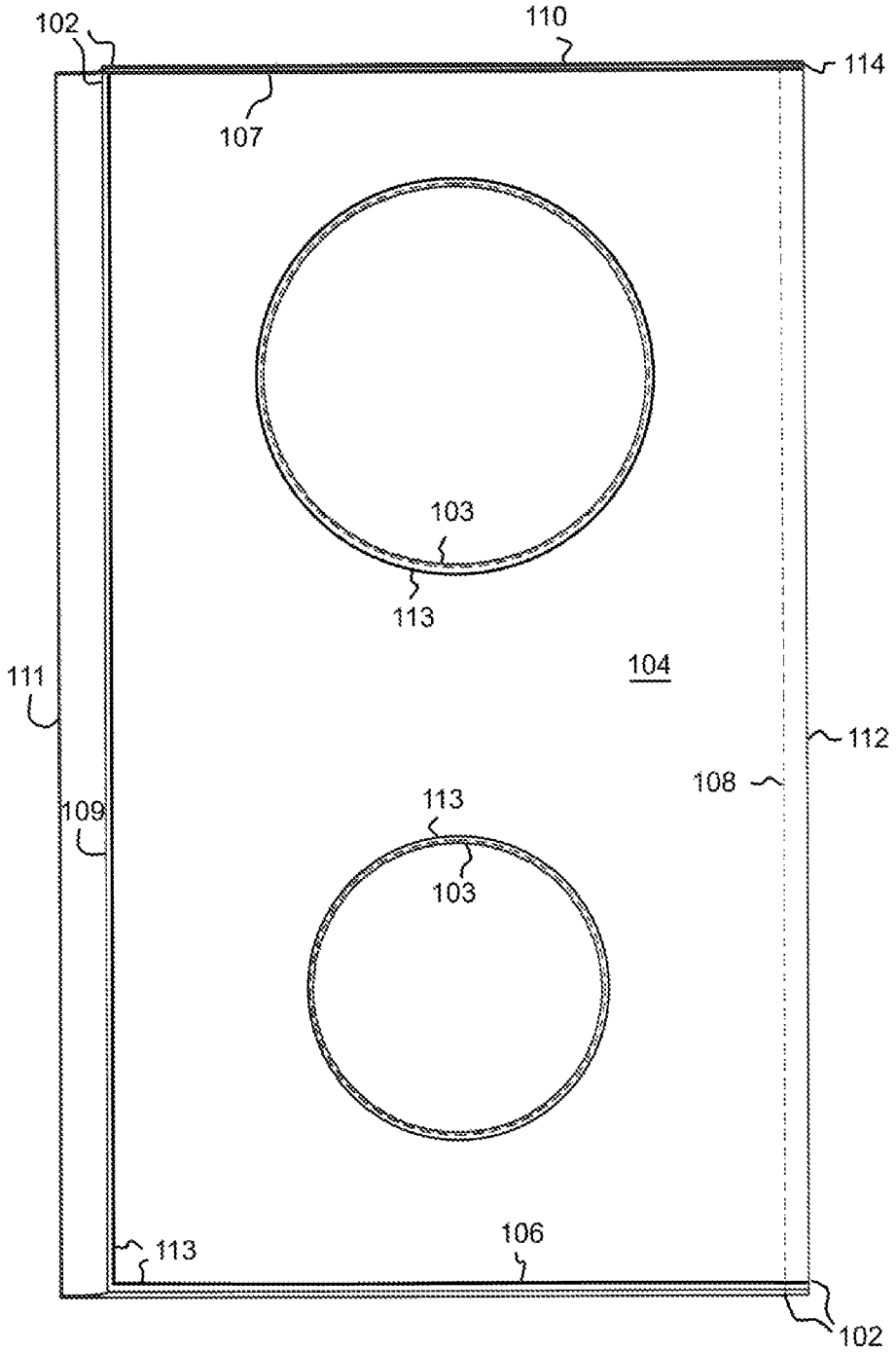
FIG. 1 is a view as seen from above of an embodiment's left surface cover section.

FIG. 1 shows left surface cover 101. Left surface cover 101 is defined by a substantially rectangular outer perimeter 102, at least one substantially circular inner perimeter 103, a top surface area 104, and a bottom surface area 105. The outer perimeter 102 is comprised of a near edge 106, a far edge 107 opposite and substantially parallel to near edge 106, a right edge 108 connected substantially perpendicularly to near edge 106 and far edge 107, and a left edge 109 connected substantially perpendicularly to near edge 106 and far edge 107 and positioned opposite to and substantially parallel to right edge 108. In the first embodiment, electric range cover 100 features a left surface cover 101 with two substantially circular inner perimeters 103. Inner perimeters 103 are given diameters so that the user's range's heating elements will pass through the center of each perimeter. Inner perimeters 103 are given a spacing distance from the center of each perimeter that corresponds to the distance between the centers of the user's range's heating elements.

Figure 2:
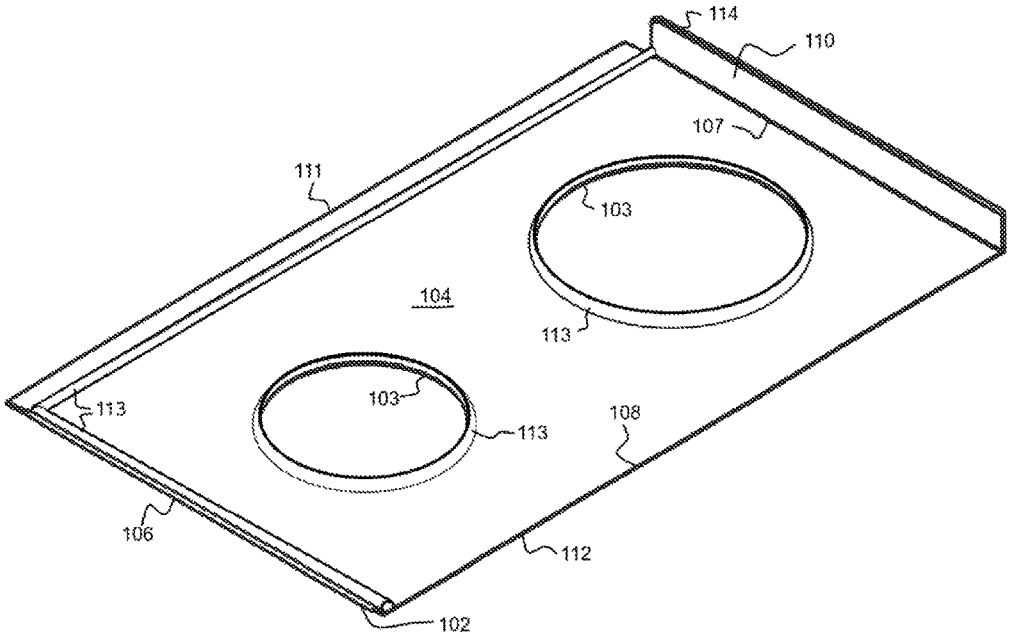
FIG. 2 is a perspective view of an embodiment's left surface cover section.
Figure 3A:
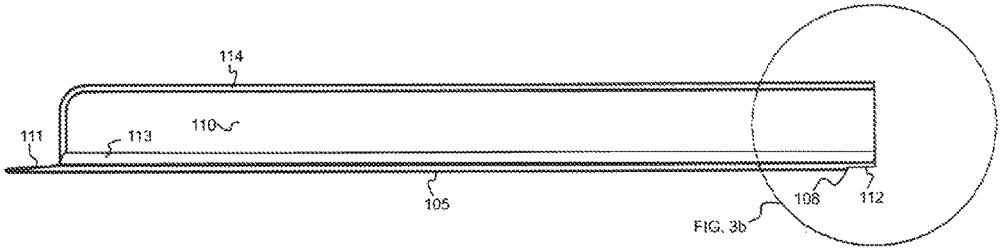
FIG. 3A is an edge view of an embodiment's left surface cover section. The edge positioned in the foreground is that edge closest to the user when the user is engaging the range. The edge in the background is the edge facing the edge of the range that is furthest from the user when engaging the range.
Figure 4:
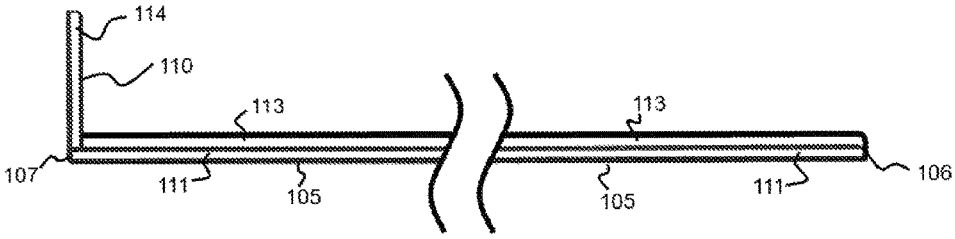
FIG. 4 is an edge view of an embodiment's left surface cover with the edge positioned in the foreground being the edge to the left of the user when the user is engaging the range. The edge in the background is the edge facing the embodiment's right surface cover section.

Referring to FIG. 2, FIG. 3A, and FIG. 4, a backsplash 110 is connected substantially perpendicularly to the plane of top surface area 104 along far edge 107. The backsplash 110 can be any height suitable to provide splash, spill, or splatter protection along the far edge of the user's range. For some range models, backsplash 110 may be suitable at a height of 1 inch; for others, a suitable height may be 12 inches. Backsplash 110 is further comprised by a backsplash ridge 114. The backsplash ridge 114 is a ridge protruding substantially perpendicular to the plane defining backsplash 110 and positioned along the edges of backsplash 110 not connected far edge 107. The backsplash ridge 114 may be shaped to have a cross sectional area defined by a hemisphere, triangle, rectangle, or any other shape, though it appears as a hemisphere in the drawings.

Referring again to FIG. 1, a left gap cover 111 is attached along left edge 109 and is positioned to be substantially in the same plane defined by top surface area 104. Left gap cover 111 can be any width suitable to provide splash, spill, or splatter protection along the left edge of the user's range. The express function of the left gap cover 111 is to cover the gap formed in between the range edge and an adjacent counter-top edge. For some range models, left gap cover 111 may be suitable at a width of 1 inch; for others, a suitable width may be 12 inches.

Figure 3B:
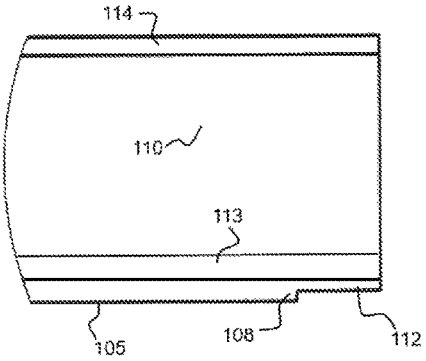
FIG. 3B is an enlarged portion of FIG. 3A.

Still referring to FIG. 1, a top lap joint 112 is attached along right edge 108 and is positioned to be substantially in the same plane defined by top surface area 104. Now referring to FIG. 3A and FIG. 3B, top lap joint 112 is pictured as a simple lap joint, though one of ordinary skill in the art will readily recognize that any number of suitable joining methods may be used including but not limited to vee joint, tongue-and-groove, keyed joint, finger joint, butt joint, or biscuit joint. These and other methods are understood to be included in the scope of this disclosure, though they do not appear in the drawings. Tongue-and-groove and lap joints are preferred methods because they create a seal even when the joint is not fully engaged. Because left surface cover 101 and right surface cover 131 are positioned adjacent to one another so that a seal is made along the top lap joint 112, this feature allows the user to adjust the spacing between left surface cover 101 and right surface cover 131 without breaking the seal created between the two. Another optional feature not pictured in the drawings is the addition of small grooves into the sealing surfaces of top lap joint 112. This has the effect of increasing the surface area of the sealing surface which in turn enhances the sealing properties.

Still referring to FIG. 1, left surface cover 101 is further comprised by a surface ridge 113. Surface ridge 113 is a ridge protruding substantially perpendicular to top surface area 104 and positioned along the inner perimeter 103, near edge 106, and left edge 109. The surface ridge 113 may be shaped to have a cross sectional area defined by a hemisphere, triangle, rectangle, or any other shape, though it appears as a hemisphere in the drawings. The height of surface ridge 113 can be any height suitable for the express purpose of providing resistance to or otherwise preventing the travel of liquids and solids.

Figure 5:
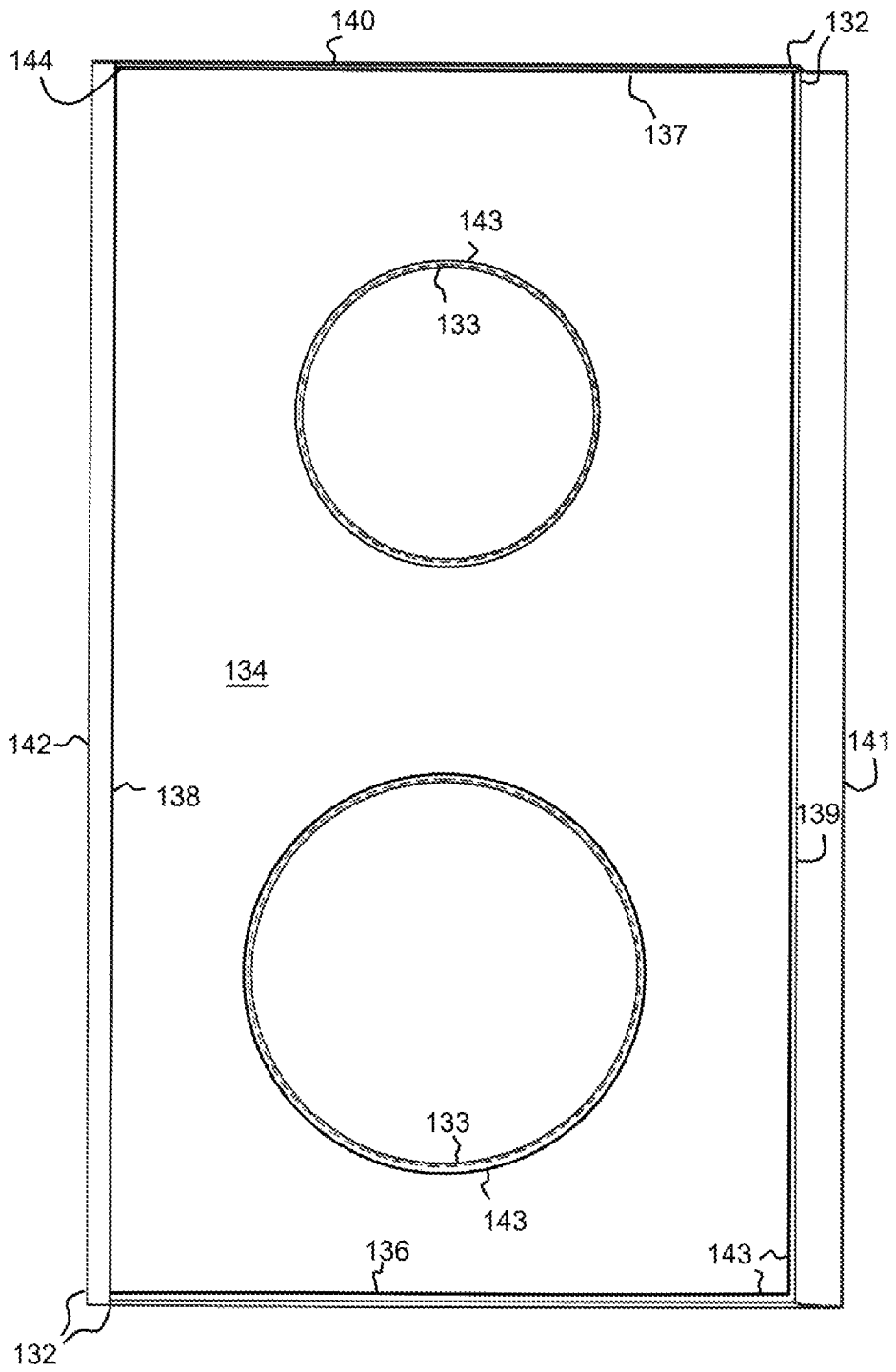
FIG. 5 is a view as seen from above of an embodiment's right surface cover section.

Still describing the first embodiment, electric range cover 100, FIG. 5 shows right surface cover 131. Right surface cover 131 is defined by a substantially rectangular outer perimeter 132, at least one substantially circular inner perimeter 133, a top surface area 134, and a bottom surface area 135. The outer perimeter 132 is comprised of a near edge 136, a far edge 137 opposite and substantially parallel to near edge 136, a right edge 138 connected substantially perpendicularly to near edge 136 and far edge 137, and a left edge 139 connected substantially perpendicularly to near edge 136 and far edge 137 and positioned opposite to and substantially parallel to right edge 138. In the first embodiment, electric range cover 100 features a right surface cover 131 with two substantially circular inner perimeters 133. Inner perimeters 133 are given diameters so that the user's range's heating elements will pass through the center of each perimeter. Inner perimeters 133 are given a spacing distance from the center of each perimeter that corresponds to the distance between the centers of the user's range's heating elements.

Figure 6:
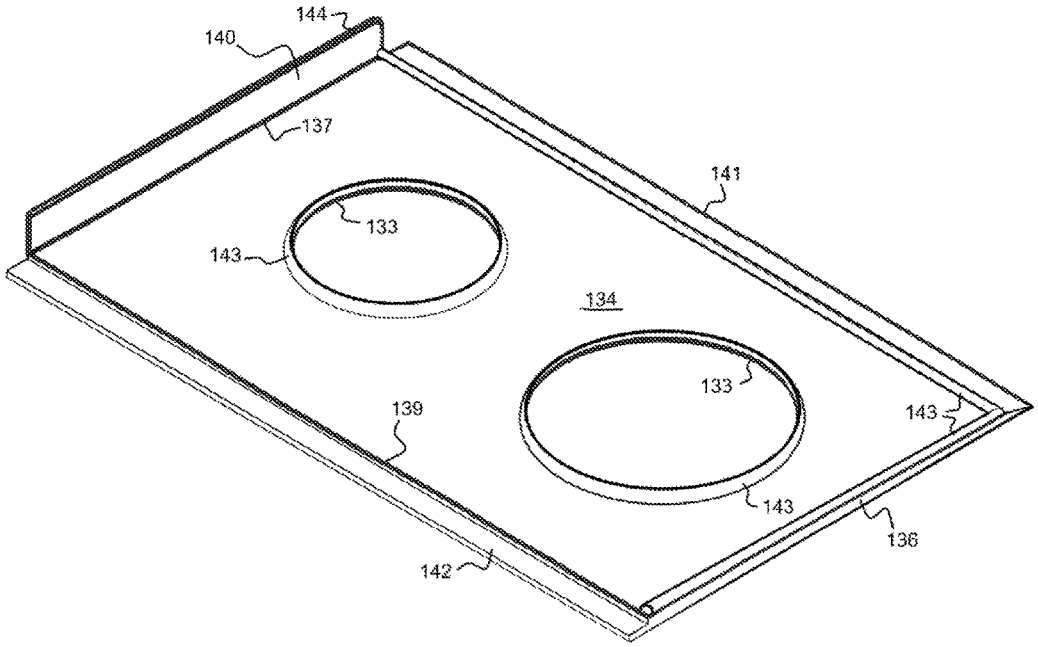
FIG. 6 is a perspective view of an embodiment's right surface cover section.
Figure 7A:
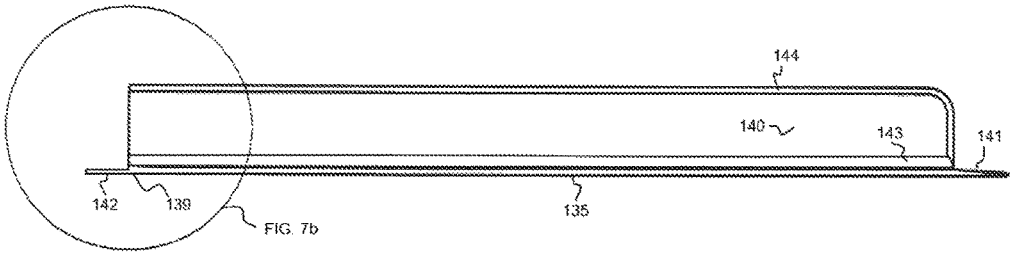
FIG. 7A is an edge view of an embodiment's right surface cover section. The edge positioned in the foreground is that edge closest to the user when the user is engaging the range. The edge in the background is the edge facing the edge of the range that is furthest from the user when engaging the range.
Figure 8:
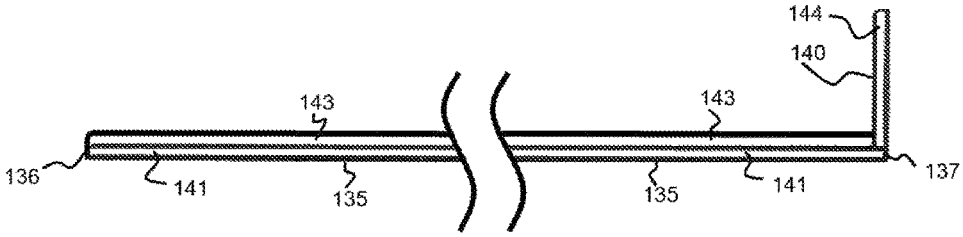
FIG. 8 is an edge view of an embodiment's right surface cover with the edge positioned in the foreground being the edge to the right of the user when the user is engaging the range. The edge in the background is the edge facing the embodiment's left surface cover section.

Referring to FIG. 6, FIG. 7A, and FIG. 8, a backsplash 140 is connected substantially perpendicularly to the plane of top surface area 134 along far edge 137. The backsplash 140 can be any height suitable to provide splash, spill, or splatter protection along the far edge of the user's range. For some range models, backsplash 140 may be suitable at a height of 1 inch; for others, a suitable height may be 12 inches. Backsplash 140 is further comprised by a backsplash ridge 144. The backsplash ridge 144 is a ridge protruding substantially perpendicular to the plane defining backsplash 140 and positioned along the edges of backsplash 140 not connected far edge 137. The backsplash ridge 144 may be shaped to have a cross sectional area defined by a hemisphere, triangle, rectangle, or any other shape, though it appears as a hemisphere in the drawings.

Referring again to FIG. 5, a right gap cover 141 is attached along right edge 138 and is positioned to be substantially in the same plane defined by top surface area 134. Right gap cover 141 can be any width suitable to provide splash, spill, or splatter protection along the right edge of the user's range. The express function of the right gap cover 141 is to cover the gap formed in between the range edge and an adjacent counter-top edge. For some range models, right gap cover 141 may be suitable at a width of 1 inch; for others, a suitable width may be 12 inches.

Figure 7B:
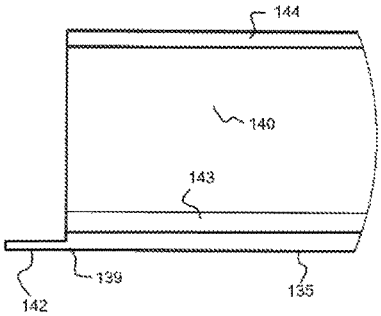
FIG. 7B is an enlarged portion of FIG. 7A.

Still referring to FIG. 5, a bottom lap joint 142 is attached along left edge 139 and is positioned to be substantially in the same plane defined by bottom surface area 135. Now referring to FIG. 7A and FIG. 7B, bottom lap joint 142 is pictured as a simple lap joint, though one of ordinary skill in the art will readily recognize that any number of suitable joining methods may be used including but not limited to vee joint, tongue-and-groove, keyed joint, finger joint, butt joint, or biscuit joint. These and other methods are understood to be included in the scope of this disclosure as other embodiments, though they do not appear in the drawings. Tongue-and-groove and lap joints are preferred methods utilized in other embodiments because they create a seal even when the joint is not fully engaged. Because left surface cover 101 and right surface cover 131 are positioned adjacent to one another so that a seal is made along the bottom lap joint 142, this feature allows the user to adjust the spacing between left surface cover 101 and right surface cover 131 without breaking the seal created between the two. Another embodiment features the addition of small grooves into the sealing surfaces of top lap joint 112 and bottom lap joint 142. This has the effect of increasing the surface area of the sealing surface which in turn enhances the sealing properties.

Still referring to FIG. 5, right surface cover 131 is further comprised by a surface ridge 143. Surface ridge 143 is a ridge protruding substantially perpendicular to top surface area 134 and positioned along the inner perimeter 133, near edge 136, and right edge 138. The surface ridge 143 may be shaped to have a cross sectional area defined by a hemisphere, triangle, rectangle, or any other shape, though it appears as a hemisphere in the drawings. The height of surface ridge 143 can be any height suitable for the express purpose of providing resistance to or otherwise preventing the travel of liquids and solids.

Figure 9:
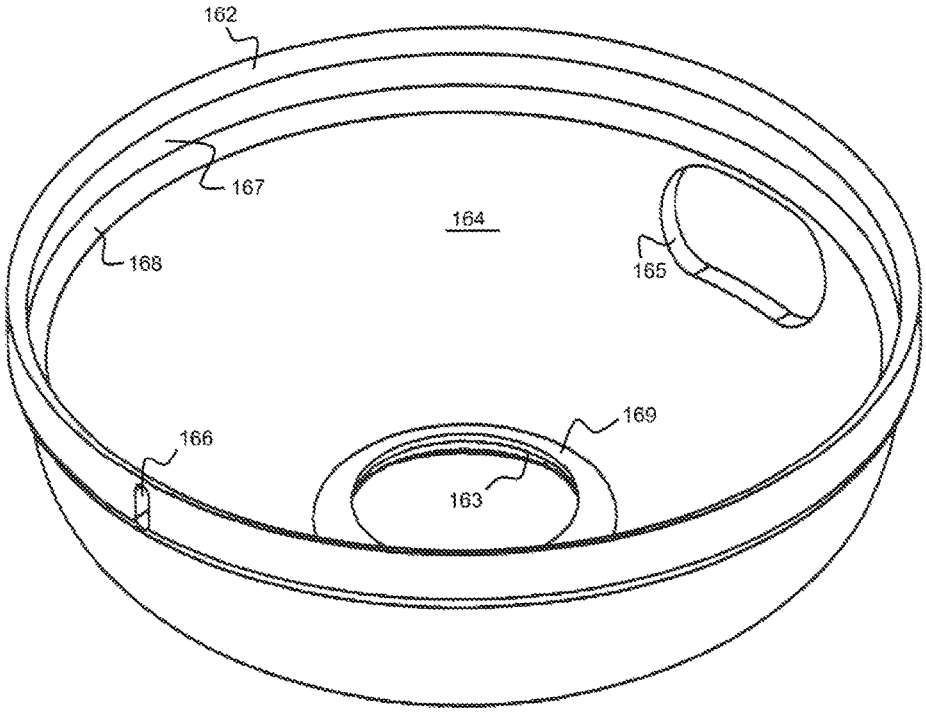
FIG. 9 is a perspective view of an embodiment's basin cover.

Still describing the first embodiment, electric range cover 100, FIG. 9. Shows a perspective view of a basin cover 161. Basin cover 161 is substantially shaped like a bowl. There is a top edge 162 connected to a bottom edge 163 by an upper ring 167, a lip 168, and a concave side wall 164. Top edge 162 and bottom edge 163 each forms substantially a circle and the two are substantially concentric to an axis running substantially perpendicular to the plane defining each. Furthermore, bottom edge 163 is positioned substantially parallel to and below the plane defining top edge 162.

Figure 10A:
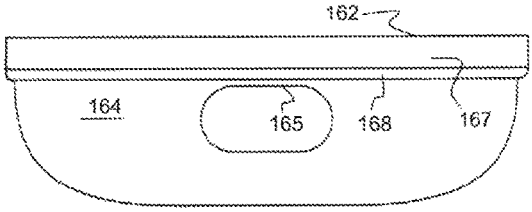
FIG. 10A is an edge view of an embodiment's basin cover.
Figure 11:
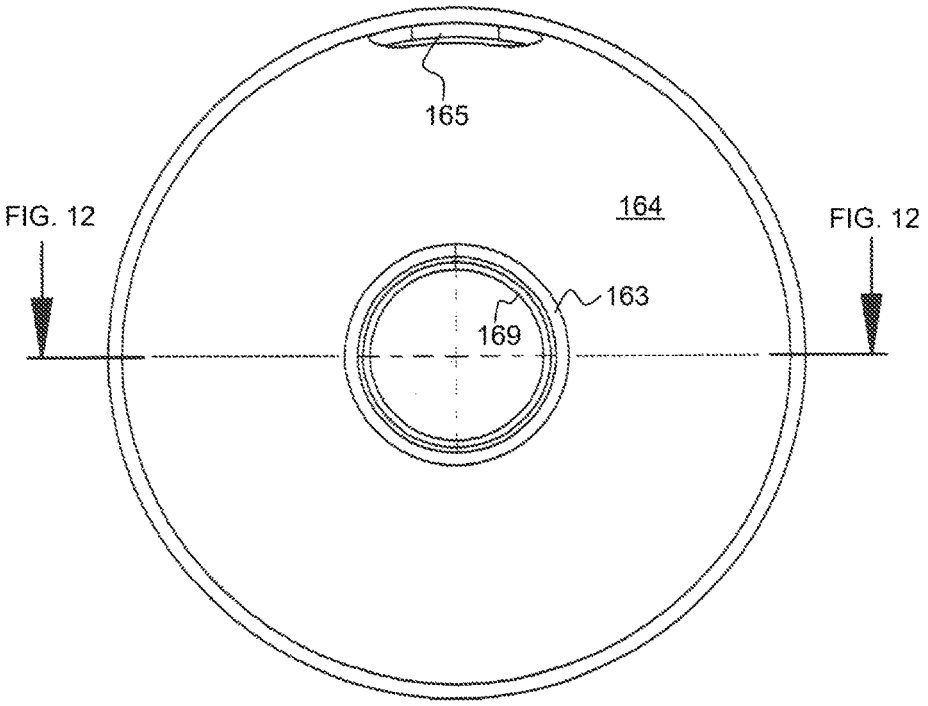
FIG. 11 is a view from the underside of an embodiment's basin cover.

A common design feature seen in the typical electric range is the inclusion of an opening in the side wall of the basin to allow the electric leads of the heating element pass through and connect with the heating element connection port. Note that the term drip-pan is sometimes used to refer to the basin in the industry. Referring now to FIG. 9, FIG. 10*a*, and FIG. 11, in the present embodiment, side wall 164 is comprised by an opening, lead port 165, to allow the electrical leads of the heating element to pass through and connect to the electric range's heating element connection port. The lead port 165 can be any shape, and of any width, appropriate to allow the electrical leads to pass through. However, in this preferred embodiment, lead port 165 is substantially shaped like a rounded rectangle and given dimensions equal to the opening in the side wall of the electric range's basin of the same purpose.

Figure 10B:
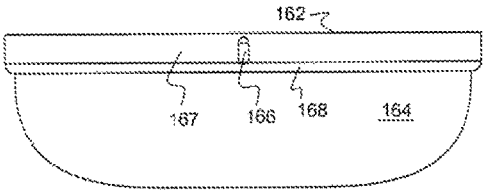
FIG. 10B is an edge view of an embodiment's basin cover opposite of the side seen in FIG. 10A.
Figure 12:
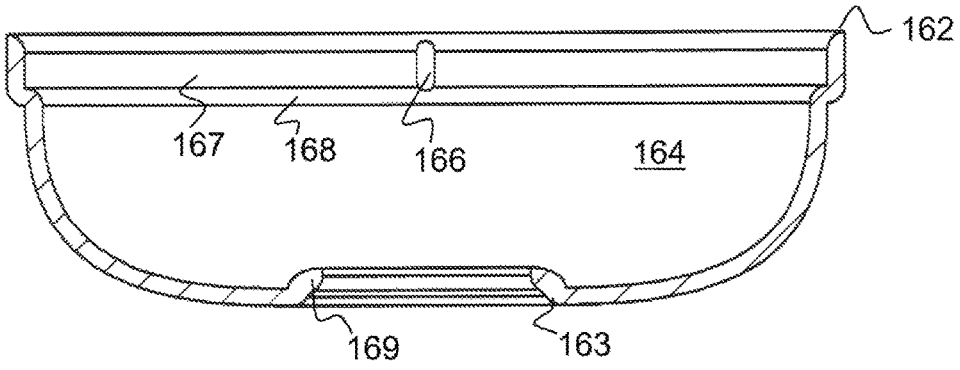
FIG. 12 is a cross sectional view of an embodiment's basin cover.
Figure 13:
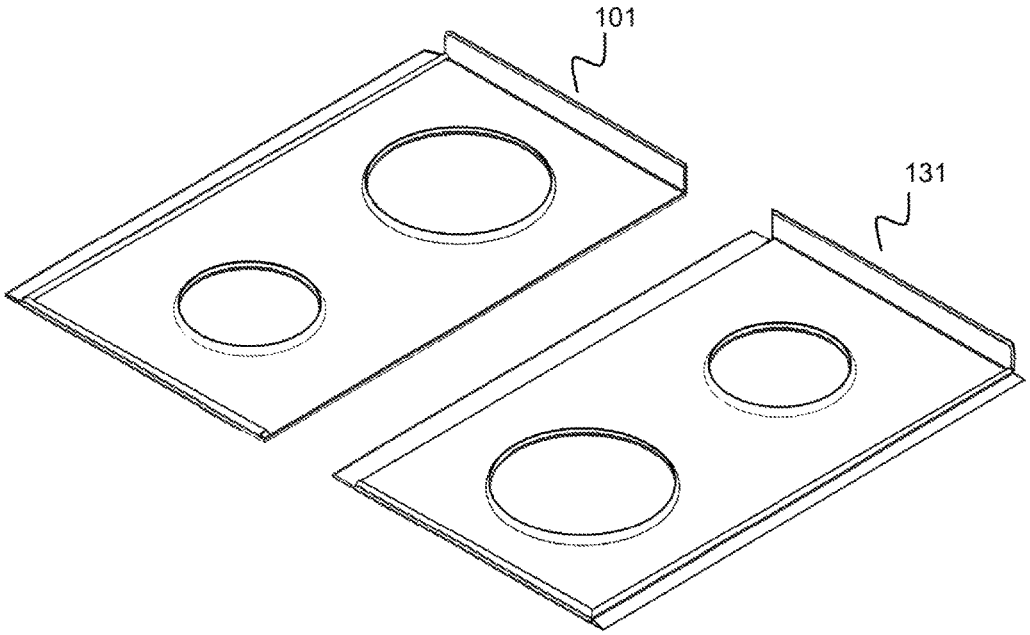
FIG. 13 is a perspective view of an embodiment's right surface cover section and left surface cover section as positioned adjacent to one another but not connected. The adjacent edges are the right and left slotted seam edges (respectively), and are ready to engage one another.
Figure 14A:
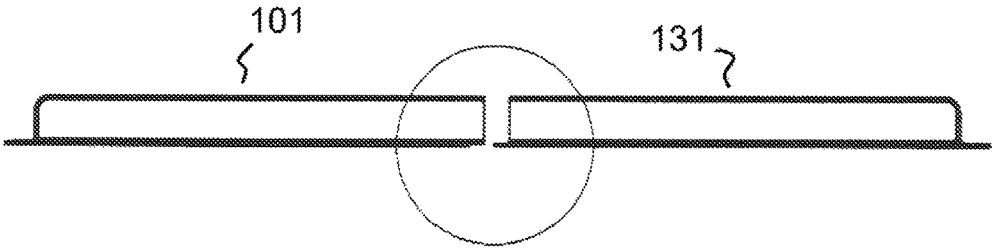
FIG. 14A shows the edge view of an embodiment's right surface cover section and left surface cover section as positioned adjacent to one another but not engaged.
Figure 14B:
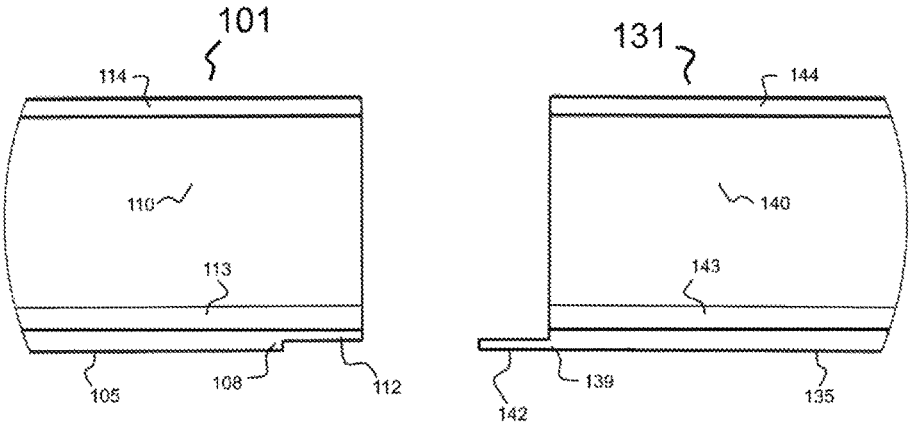
FIG. 14B shows the enlarged edge view of an embodiment's right surface cover section and left surface cover section as positioned adjacent to one another but not engaged.
Figure 14C:
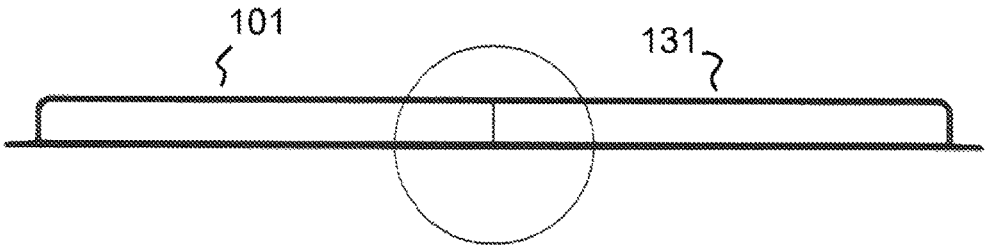
FIG. 14C shows the edge view of an embodiment's right surface cover section and left surface cover section as positioned adjacent to one another and engaged.
Figure 14D:
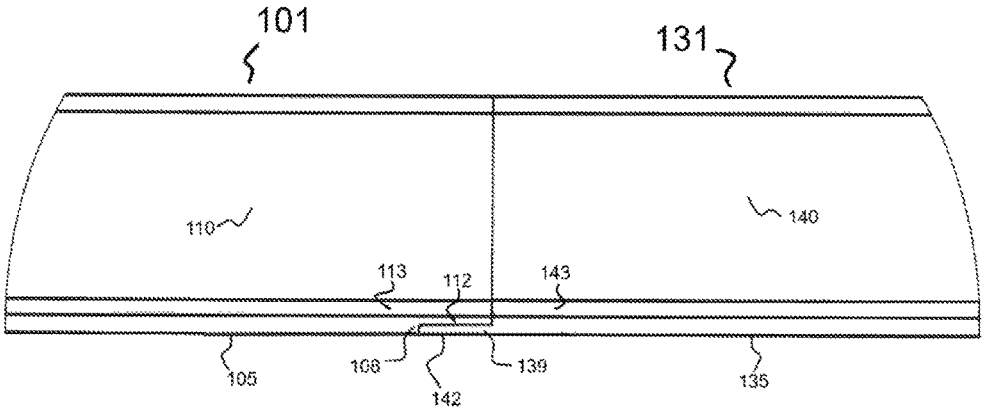
FIG. 14D shows the enlarged edge view of an embodiment's right surface cover section and left surface cover section as positioned adjacent to one another and engaged

Another common design feature seen in the typical electric range is the inclusion of a small slit in the basin. This slit is located at the upper ring defining a lip in the basin. The purpose of this slit is to accept a support leg. The support leg is typically one of three legs extending from a center point of the heating element. The support legs are spaced 120 degrees apart to provide an evenly spaced platform of support by resting on the lip of the basin. By accepting the support leg positioned opposite the heating element electrical leads into the basin slit, the heating element is centered over the basin and resists vertical and lateral movement. Referring now to FIG. 9, FIG. 10*b*, and FIG. 12, in the present embodiment, top edge 162 defines the top edge of upper ring 167. The ring 167 has a diameter slightly greater than the diameter of side wall 164 creating a lip 168. The bottom edge of upper ring 167 is connected to side wall 164 by lip 168. There is an opening, alignment port 166, in upper ring 167. Alignment port 166 is located directionally opposite lead port 165 but is positioned in the upper ring 167 rather than in side wall 164.

Referring now to FIG. 9, FIG. 11, and FIG. 12, basin cover 161 has an inner ridge 169 located along bottom edge 163. This inner ridge 169 is a ridge protruding substantially perpendicular to the plane in which bottom edge 163 is located. The inner ridge 169 may be shaped to have a cross sectional area defined by a hemisphere, triangle, rectangle, or any other shape, though it appears as a rounded trapezoid in the drawings. The height of inner ridge 169 can be any height suitable for the express purpose of providing resistance to or otherwise preventing the travel of liquids and solids.

Figure 15:
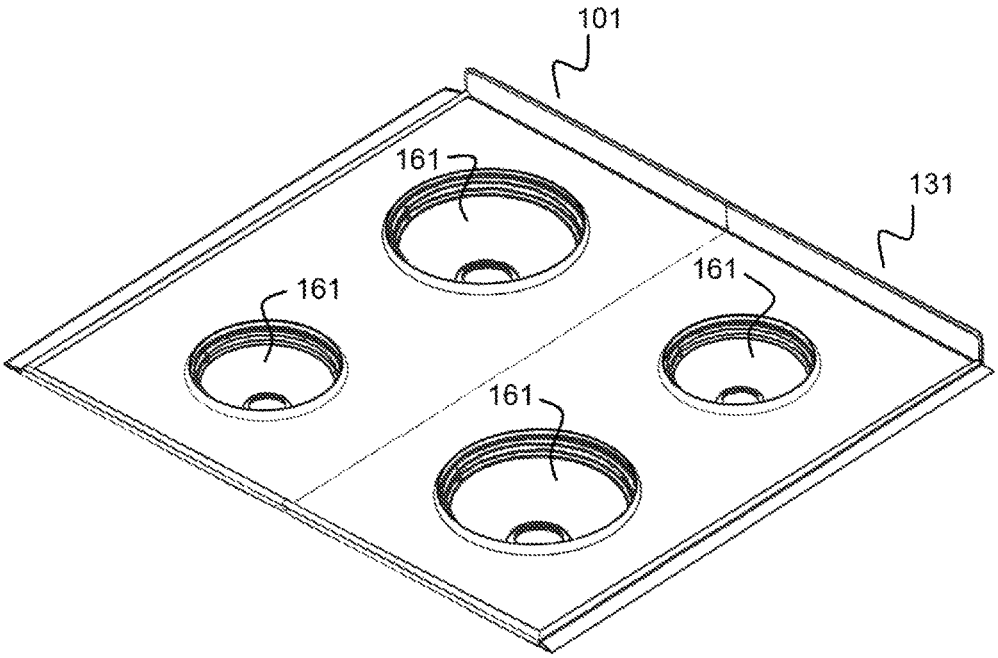
FIG. 15 shows a perspective view of an assembled embodiment featuring a right surface cover section, a left cover section, and four basin covers.

Still referring to the first embodiment, in order to assemble electric range cover 100 on user's range, refer now to FIG. 13, FIG. 14A, FIG. 14B, FIG. 14C, and FIG. 14D. Left surface cover 101 and right surface cover 131 are aligned on the surface of user's range so that top lap joint 112 and bottom lap joint 142 are adjacent and substantially co-planar. By urging left surface cover 101 and right surface cover 131 together, top lap joint 112 and bottom lap joint 142 will connect to form a seal. The substantially circular inner perimeters 103 should be concentrically aligned over the center of the range heating elements. Now referring to FIG. 15, one basin cover 161 should be placed above each range basin (drip-pan) as desired by user, so that the lead port 165 and alignment port 166 are aligned with the basin's electrical lead opening and alignment slit, respectively. Thereafter, any heating elements and grates are replaced and the range is then ready for use.

In another embodiment, not depicted in the drawings, top lap joint 112 and bottom lap joint 142 are replaced by a seam comprised by a section of pleats (a series of folds in the material). The pleats allow the left surface cover 101 and right surface cover 131 to be moved towards and away from one another for the purpose of adjusting the range cover to fit the user's range without compromising the range protection by leaving a gap of exposed range surface.

The first embodiment was specifically set out with application to a user's electric range, however one of ordinary skill in the art will recognize that many of the embodiment's features are equally well suited for other range styles including a gas range or a glass top with heating zones, etc. In another embodiment, inner perimeters 103 and 133 may take any shape necessary to create an efficient border around the range's heating zone. By way of example, another embodiment may feature an inner perimeter 103 and 133 wherein the shape is substantially square; in yet another embodiment the shape may be substantially square but with rounded corners. Likewise, in the aforementioned embodiments the basin cover 161 may also take any shape necessary to create a cover that conforms substantially to the surface directly below the source of heat, such as the gas burners in the gas range. For example, in another embodiment, the top edge 162 may be defined as substantially square; in yet another embodiment the top edge 162 may be substantially square but with rounded corners and cut outs for the range grate legs to pass through.

In another embodiment similar to electric range cover 100, the range cover does not feature a backsplash 110 and backsplash 140.

In another embodiment similar to electric range cover 100, the range cover's backsplash 110 and backsplash 140 do not feature backsplash ridge 114 and backsplash ridge 144.

In another embodiment similar to electric range cover 100, the range cover does not feature a surface ridge 113 and surface ridge 143.

In another embodiment similar to electric range cover 100, the range cover's surface ridge 113 is only located along inner perimeters 103 and inner perimeters 113.

In another embodiment similar to electric range cover 100, the range cover does not feature a left gap cover 111 and right gap cover 141.

In another embodiment similar to electric range cover 100, the range cover's left gap cover 111 and right gap cover 141 have an additional elongated member protruding substantially perpendicular to the plane defining the countertop and range surfaces. The additional elongated member will thereby be caused to extend into the gap between the countertop and range when the range cover is applied to the user's range.

In another embodiment, not included in the drawings, at least one or a multiplicity of magnets is embedded into the range cover at or just below the surface adjacent to the user's range, comprising bottom surface area 105, bottom surface area 135, and basin cover 161. In a subset of that embodiment, the magnets are dispersed throughout the entire cover; in another subset of that embodiment, the magnets are located at the periphery of the cover.

In another embodiment, not included in the drawings, at least one or a multiplicity of adhesives is attached onto the range cover surface adjacent to the user's range, comprising bottom surface area 105, bottom surface area 135, and basin cover 161. In a subset of that embodiment, the adhesives are dispersed throughout the entire cover; in another subset of that embodiment, the adhesives are located at the periphery of the cover. These adhesives can be reusable or single use and are preferentially heat and flame resistant.

In another embodiment, not included in the drawings, at least one or a multiplicity of low-profile suction cups is formed into or attached onto the range cover at or just below the surface adjacent to the user's range, comprising bottom surface area 105, bottom surface area 135, and basin cover 161. In a subset of that embodiment, the suction cups are dispersed throughout the entire cover; in another subset of that embodiment, the suction cups are located at the periphery of the cover.

In another embodiment, the range cover features an edge guard that extends downwardly along the exterior perimeter of the range. This helps to secure the range cover in place on the user's range and provides a barrier of protection along the outwardly facing edges and side wall faces of the user's range. A suitable depth can extend from less than 1 inch to 12 inches or more.

In another embodiment, the range cover is comprised of only one surface cover.

In another embodiment, the range cover is comprised of a multiplicity of surface covers.

In another embodiment, the surface cover's outer perimeter is not substantially rectangular.

In another embodiment the surface cover features only one inner perimeter.

In another embodiment the surface cover features a multiplicity of inner perimeters.

In another embodiment the surface cover's inner perimeter is not substantially circular but instead takes the perimeter shape of the user's range's heating element.

In another embodiment the surface cover features additional inner perimeters for other surface elements of the range, such as control knobs or grate footings.

In another embodiment the surface cover does not have a backsplash, but instead has the surface ridge continued across the far edge of the surface cover.

In another embodiment, not included in the drawings, the range cover can be enhanced by a graphic, for example by use of decorations, text, images, patterns, embellishments, etc. The graphic may be applied by stamping, printing, embedding, embossing, stenciling, use of overlaid materials, or any other suitable means.

In any of the embodiments described above, the range cover can be given the dimensions and proportions to fit any range design. It should be appreciated that the range cover can be manufactured to retro-fit existing user's ranges or to be sold with new range appliances heretofore not yet commercially available.

The embodiments described above can be made of any suitable material that is heat and flame resistant, and that is preferentially also stain and stick resistant. Such materials include most metals and their alloys, ceramics, glass, certain polymers, certain rubbers, certain thermosetting materials, etc. Among these, there are known materials which are preferred such as commercial-kitchen or industrial grade silicone, stainless steel, and aluminum, each of which could be used with or without an added coating such as Teflon® for non-stick property enhancement. Furthermore any of the qualifying materials could be combined in many other different ways. As stated before a combination might be used to add properties to the surface, as with a surface coating. Other combinations include the addition of internal components such as a ceramic fiber for increased durability; or external components such as reinforcing metal rings or bars for selective rigidity.

Although the invention has been described and illustrated with a certain degree of detail or with reference to one or more particular embodiments, it is understood that the present disclosure has been made only by way of example. It should be understood that the invention is not intended to be limited to the particular forms disclosed. Furthermore, the invention is amenable to various modifications and alternative forms. Obvious variations and other various changes in the composition, combination, and arrangement of parts can be utilized to by those skilled in the art without departing from the spirit and scope of the invention, as herein disclosed and claimed.

What is claimed is:

1. A range cover system comprised of:

at least one surface cover, wherein said at least one surface cover is comprised by an outer perimeter and at least one inner perimeter, further wherein the at least one inner perimeter defines an opening through the surface cover, and wherein the surface cover is adapted to be applied to a range surface of a range of a user; and at least one basin cover, wherein said at least one basin cover is comprised by a top edge, a bottom edge, and a sidewall connecting said top edge and said bottom edge, and wherein said at least one basin cover is adapted to be applied to a range basin surface of the range of the user and is not connected to the surface cover.

2. The range cover system of claim 1 wherein the said at least one surface cover is comprised by an outer perimeter surface ridge along the outer perimeter of the surface cover that coincides with the edge of the user's range and an inner perimeter surface ridge positioned along the inner perimeter of the surface cover, such that the said outer perimeter surface ridge and inner perimeter surface ridge impede the travel of liquids and solids.

3. The range cover system of claim 1 wherein the said at least one surface cover is comprised by at least one gap cover attached to the outer perimeter of said at least one surface cover, such that the said at least one gap cover is positioned over a gap formed between the user's range and an adjacent counter-top.

4. The range cover system of claim 1 wherein the said at least one surface cover is comprised by a backsplash connected to the said at least one surface cover along an edge coinciding with a back edge of the user's range, whereby the backsplash is extending substantially perpendicular to the plane substantially defining the surface cover, such that the said backsplash impedes the travel of liquids and solids.

5. The range cover system of claim 1 wherein the said at least one basin cover is comprised by an inner ridge, wherein the inner ridge is positioned along the bottom edge, such that the said inner ridge impedes the travel of liquids and solids.

6. The range cover system of claim 1 wherein the said at least one basin cover is comprised by a lead port, wherein the lead port is positioned in the side wall, such that a user's range's heating element can pass through to a heating element lead connection port.

7. The range cover system of claim 1 wherein the said at least one basin cover is comprised by:

an upper ring positioned between the top edge and the sidewall, where the upper ring is of a larger diameter than the sidewall;

a lip positioned between and connecting the upper ring and the sidewall; and an alignment port, wherein the alignment port is positioned in the upper ring coinciding with a user's range's basin's alignment slit, such that a user's range's heating element's support leg can pass through to the basin alignment slit.

8. The range cover system of claim 1 wherein there are at least two surface covers, which can be optionally connected by a user to form a seal by positioning the at least two surface covers adjacently on the user's range.

9. The range cover system of claim 8 wherein the seal is formed at a joint selected from the group comprised by a lap joint, a vee joint, a tongue-and-groove joint, a keyed joint, a finger joint, a butt joint, and a biscuit joint, wherein each of the at least two surface covers has a joint sealing surface.

10. The range cover system of claim 9 wherein the seal is enhanced by a series of ridges located on the surface of the joint's sealing surface, such that when the at least two surface covers are positioned adjacently and the joint sealing surfaces are engaged with one another, then the ridges of each joint sealing surface will interlock with the adjacent joint sealing surface ridges.

11. The range cover system of claim 1 wherein the there are at least two surface covers, connected by an expandable seam, further wherein the seam is formed by a series of folds that allow for lateral compression or extension of the at least two surface covers relative to one another.

12. The range cover system of claim 1 wherein the range cover system is constructed of at least one material, wherein the at least one material has the physical properties of being heat and flame resistant and impermeable to liquids.

13. The range cover system of claim 12 wherein the at least one material is selected from the group comprising metals and their alloys, ceramics, glass, polymers, rubbers, and thermosetting materials.

14. The range cover system of claim 12 wherein the at least one material has the physical property of being stain and stick resistant.

15. The range cover system of claim 1 wherein the range cover system is further comprised of at least one graphic selected from the group comprised of images, patterns, art, decorations and embellishments, and text.

16. The range cover system of claim 1 wherein the said at least one surface cover is comprised by an edge guard connected to the said at least one surface cover along an edge coinciding with the edge of the user's range, whereby the edge guard is extending substantially perpendicular to the plane substantially defining the surface cover, such that the said edge guard extends down towards the exterior perimeter of the user's range when the surface cover is applied to the user's range.

17. The range cover system of claim 1 wherein the range cover system is further comprised of at least one adherence device selected from the group comprising a magnet, an adhesive film, and a low-profile suction cup, and further wherein the said at least one adherence device is attached to the range cover system such that the at least one adherence device engages a surface of the user's range.

18. A range cover system comprising:

at least a first surface cover and a second surface cover;

wherein the first surface cover is comprised by a first outer perimeter and at least one first inner perimeter, further wherein the at least one first inner perimeter defines an opening through the first surface cover, and wherein the first surface cover is adapted to be applied to a user's range surface;

further wherein the said first surface cover is comprised by a first outer perimeter surface ridge along the first outer perimeter of the first surface cover that coincides with the perimeter of the user's range and a first inner perimeter surface ridge positioned along the first inner perimeter of the first surface cover, such that the said first outer perimeter surface ridge and first inner perimeter surface ridge impede the travel of liquids and solids;

further wherein the first surface cover is comprised by a first joint edge positioned along a first edge that coincides with a user's range surface interior area;

wherein the second surface cover is comprised by a second outer perimeter and at least one second inner perimeter, further wherein the at least one second inner perimeter defines an opening through the second surface cover, and wherein the second surface cover is adapted to be applied to a user's range surface;

further wherein the said second surface cover is comprised by a second outer perimeter surface ridge along the second outer perimeter of the second surface cover that coincides with the perimeter of the user's range and a second inner perimeter surface ridge positioned along the second inner perimeter of the second surface cover, such that the said second outer perimeter surface ridge and the second inner perimeter surface ridge impede the travel of liquids and solids;

further wherein the second surface cover is comprised by a second joint edge positioned along a second edge that coincides with a user's range surface interior area;

a first gap cover attached to the first outer perimeter of said first surface cover, such that the said first gap cover is positioned opposite the first joint edge and is over a first gap formed between the user's range and an adjacent counter-top;

a second gap cover attached to the second outer perimeter of said second surface cover, such that the said second gap cover is positioned opposite the second joint edge and is over a second gap formed between the user's range and an adjacent counter-top;

a first backsplash connected to the first surface cover along a third edge coinciding with a back edge of the user's range, whereby the first backsplash is extending substantially perpendicular to the plane substantially defining the first surface cover, such that the said first backsplash impedes the travel of liquids and solids;

a second backsplash connected to the second surface cover along a fourth edge coinciding with a back edge of the user's range, whereby the second backsplash is extending substantially perpendicular to the plane substantially defining the second surface cover, such that the said second backsplash impedes the travel of liquids and solids;

additionally, wherein the at least the first surface cover and the second surface cover can be optionally connected to form a seal at the joint formed by engaging the first joint edge with the second joint edge on the user's range;

at least one basin cover, wherein said at least one basin cover is comprised by a top edge, an upper ring, a lip, a sidewall, and a bottom edge, where the top edge is connected to the upper ring, and the upper ring is of a larger diameter than the sidewall, further where the lip is positioned between and connects the upper ring and the sidewall, further where the bottom edge is connected to the sidewall, and wherein said at least one basin cover is adapted to be applied to the user's range basin surface and is not connected to the at least the first surface cover and the second surface cover;

further wherein said at least one basin cover is additionally comprised of an alignment port, wherein the alignment port is positioned in the upper ring coinciding with a user's range's basin's alignment slit, such that a user's range's heating element's support leg can pass through to the basin alignment slit;

further wherein the said at least one basin cover is comprised by an inner ridge, wherein the inner ridge is positioned along the bottom edge, such that the said inner ridge impedes the travel of liquids and solids; and further wherein the said at least one basin cover is comprised by a lead port, wherein the lead port is positioned in the side wall opposite the alignment port, such that a user's range's heating element can pass through to a heating element lead connection port.

* * * * *